US007810664B2

(12) United States Patent
Trude

(10) Patent No.: US 7,810,664 B2
(45) Date of Patent: Oct. 12, 2010

(54) SQUEEZABLE MULTI-PANEL PLASTIC CONTAINER WITH SMOOTH PANELS

(75) Inventor: Gregory Trude, Seven Valleys, PA (US)

(73) Assignee: Graham Packaging Company, L.P., York, PA (US)

( * ) Notice: Subject to any disclaimer, the term of this patent is extended or adjusted under 35 U.S.C. 154(b) by 891 days.

(21) Appl. No.: 11/529,487

(22) Filed: Sep. 29, 2006

(65) Prior Publication Data

US 2007/0090083 A1 Apr. 26, 2007

(51) Int. Cl.
*B65D 90/02* (2006.01)

(52) U.S. Cl. ..... 215/384; 215/381; 215/382; 220/675

(58) Field of Classification Search ..... 215/381–384; 220/675, DIG. 12; D9/539
See application file for complete search history.

(56) References Cited

U.S. PATENT DOCUMENTS

D191,069 S * 8/1961 Schacher ..... D9/543
3,536,500 A * 10/1970 Cleereman et al. ..... 426/130
D234,911 S * 4/1975 Stevens, Jr. ..... D9/529
D263,026 S 2/1982 Beechuk et al.
4,946,053 A 8/1990 Conrad
5,092,474 A 3/1992 Leigner
5,101,990 A * 4/1992 Krishnakumar et al. ..... 215/383
D335,455 S * 5/1993 Brown ..... D9/537
5,226,538 A 7/1993 Roselle
5,303,834 A 4/1994 Krishnakumar et al.
5,330,054 A * 7/1994 Brown ..... 206/459.5
5,472,105 A * 12/1995 Krishnakumar et al. ..... 215/384
5,690,244 A * 11/1997 Darr ..... 215/382
D399,391 S * 10/1998 Malvasi et al. ..... D7/510
5,971,184 A 10/1999 Krishnakumar et al.
6,044,996 A 4/2000 Carew et al.
D435,453 S * 12/2000 Krishnakumar et al. ..... D9/537
D436,042 S * 1/2001 Krishnakumar et al. ..... D9/537
D436,043 S * 1/2001 Krishnakumar et al. ..... D9/537
D442,492 S * 5/2001 Krishnakumar et al. ..... D9/537
D446,730 S 8/2001 Adee et al.
D462,273 S 9/2002 Crawford
6,513,669 B2 * 2/2003 Ozawa et al. ..... 215/381
6,637,613 B2 * 10/2003 Shimada et al. ..... 215/382
D482,976 S * 12/2003 Melrose ..... D9/537

(Continued)

FOREIGN PATENT DOCUMENTS

EP 1 431 190 A 6/2004

(Continued)

OTHER PUBLICATIONS

"And Constar Makes Three in the Hot-Fill, Panel-Less Bottle Race Packaging Strategies," Aug. 31, 2005, p. 5 (www.packstrat.com).

*Primary Examiner*—Mickey Yu
*Assistant Examiner*—Ned A Walker
(74) *Attorney, Agent, or Firm*—Knoble Yoshida & Dunleavy, LLC

(57) ABSTRACT

The present invention relates to a plastic container comprising two substantially smooth opposing squeezable panels, separated by a vacuum panel and having at least one arcuate indentation adapted to allow flexure of the respective panel without permanent distortion or creasing when a force is applied to the panel toward the container interior.

13 Claims, 6 Drawing Sheets

U.S. PATENT DOCUMENTS

| | | | | |
|---|---|---|---|---|
| 6,739,467 | B2 * | 5/2004 | Saito et al. | 215/384 |
| 6,837,390 | B2 | 1/2005 | Lane et al. | |
| 6,920,992 | B2 * | 7/2005 | Lane et al. | 215/381 |
| 7,014,056 | B2 * | 3/2006 | Trude | 215/381 |
| D525,529 | S * | 7/2006 | Oguchi et al. | D9/520 |
| 7,137,520 | B1 | 11/2006 | Melrose | |
| D533,785 | S * | 12/2006 | Corbett et al. | D9/538 |
| D536,255 | S * | 2/2007 | Corbett et al. | D9/538 |
| 7,191,910 | B2 * | 3/2007 | Deemer et al. | 215/381 |
| D542,666 | S * | 5/2007 | Trude | D9/551 |
| 7,213,719 | B2 * | 5/2007 | Pedmo et al. | 215/381 |
| 7,296,702 | B2 * | 11/2007 | Tanaka et al. | 215/383 |
| 7,377,399 | B2 * | 5/2008 | Lane et al. | 215/381 |
| 7,416,090 | B2 * | 8/2008 | Mooney et al. | 215/381 |
| 7,455,189 | B2 * | 11/2008 | Lane et al. | 215/381 |
| 7,472,798 | B2 * | 1/2009 | Stowitts | 215/381 |
| 2001/0022291 | A1 * | 9/2001 | Shimada et al. | 215/382 |
| 2001/0035392 | A1 * | 11/2001 | Ota et al. | 215/381 |
| 2001/0054597 | A1 * | 12/2001 | Ozawa et al. | 215/381 |
| 2002/0092821 | A1 * | 7/2002 | Saito et al. | 215/384 |
| 2003/0136754 | A1 | 7/2003 | Bourque et al. | |
| 2004/0016716 | A1 * | 1/2004 | Melrose et al. | 215/381 |
| 2005/0067369 | A1 * | 3/2005 | Trude | 215/381 |
| 2005/0121408 | A1 * | 6/2005 | Deemer et al. | 215/381 |
| 2005/0139572 | A1 * | 6/2005 | Pedmo et al. | 215/381 |
| 2006/0065618 | A1 * | 3/2006 | Pedmo et al. | 215/381 |
| 2006/0070977 | A1 * | 4/2006 | Howell et al. | 215/384 |
| 2007/0075032 | A1 | 4/2007 | Kelley et al. | |

FOREIGN PATENT DOCUMENTS

| | | |
|---|---|---|
| NZ | 239179 | 5/2000 |
| NZ | 513783 | 12/2003 |
| NZ | 516023 | 4/2004 |
| WO | WO 00/50309 | 8/2000 |
| WO | WO 00/68095 | 11/2000 |
| WO | WO 2005/067419 A | 7/2005 |
| WO | WO 2006/039523 | 3/2006 |

* cited by examiner

SQUEEZABLE MULTI-PANEL PLASTIC CONTAINER WITH SMOOTH PANELS

CROSS REFERENCE TO RELATED APPLICATION

This application claims the priority of U.S. Provisional Patent Application No. 60/722,069, filed Sep. 30, 2005, which is hereby incorporated by reference.

FIELD OF THE INVENTION

The present invention relates to squeezable plastic containers. More particularly, the invention relates to containers having squeezable panels separated by vacuum panels.

BACKGROUND OF THE INVENTION

Containers holding liquids or other products are designed to accommodate for changes in internal pressure created during packaging or subsequent handling.

For example, hot-filled plastic containers are used for packaging certain liquids, which must be filled into the container while hot. During filling, the product is typically dispensed into the container at elevated temperatures of at least about 82 degrees Celsius. The container is then capped and, as the product cools, a negative internal pressure forms within the sealed container. Improper design may lead to deformation resulting in poor aesthetics, performance and end-user handling. Hot-filled plastic containers are typically blow molded from polyester resin and other suitable polymeric materials, such as biaxially-oriented polyethylene terephthalate (PET), and having a base, a generally cylindrical body, a shoulder, and a neck.

Internal negative pressure may also be created when a packaged product is placed in a cooler environment, e.g., placing a bottle in a refrigerator or a freezer.

To accommodate the shrinkage and negative internal pressure that develops during packaging or subsequent handling, it is known to incorporate a plurality of recessed vacuum panels into the body portion of the container. As the product cools, the vacuum panels will deform and move inwardly thereby relieving internal pressure. Labels may be used around the bell-shaped shoulder portion or to cover the vacuum panels to improve the appearance of the container.

The design of vacuum panels may vary. For example, WO 00/50309, Melrose, discloses a container comprising controlled deflection flex panels having initiator portions that may invert and flex under pressure to avoid deformation and permanent buckling, and U.S. Pat. No. 5,971,184, Krishnakumar et al., discloses containers comprising only two vacuum panels and two reinforcing sections (finger grip portions).

However, in a hot-fill PET container, geometry is necessary so as to make the package relatively rigid; and therefore not conducive to squeezeability. Any portion that was allowed to move was done so for vacuum take-up, and these sections were not typically setup to be squeezable. Squeezable containers having vacuum panels, include, for example, U.S. Pat. No. 5,303,834, Krishnakumar, et al., disclosing a squeezable container having a six stepped vacuum panel profile for greater flexibility and resilience, and U.S. Pat. No. 6,837,390, Lane et al., disclosing a container, which can be a squeezable container, comprising a pair of opposing panels and a pair of opposing columns and forming a substantially oval cross section, wherein the columns deflect outwardly as the vacuum panels deflect inwardly during hot-fill processing. All references are hereby incorporated by reference.

However, standard six panel designs present difficulties with labeling and end-user handling, and two panel designs show tendency to pull on the columns or grip areas during the optimization to increase volume contraction and reduce pressure. This may contribute to unnecessary distortion on the rigid columns or grip areas and/or on the vacuum panels. Also, the substantially oval shape of these designs often leads to distortion of the shoulder and/or bottom portions of the container, thereby distorting around labels. Moreover, squeezing these containers can often require a higher force which essentially crushes the container.

SUMMARY OF THE INVENTION

The foregoing deficiencies are overcome by the present invention. In an exemplary embodiment, the invention reduces these effects by utilizing four controlled deflection flex vacuum panels, working in tandem in primary and secondary capacity, thereby reducing the internal pressure and increasing the amount of vacuum uptake and reducing label distortion, while still providing grippable regions to facilitate end user/consumer handling. Moreover, the unique design of the present container provides a relatively lightweight container with top-load strength similar to that of a heavier container. In addition, two of the panels are constructed to be primarily smooth with definitive arcuate indentations to provide points for easier flexing and bending when force is applied in such a way as to compress them onto each other and thereby limiting the damage to the rest of the package.

The present invention relates to a container comprising a plastic body having a neck portion defining an opening, connected to a shoulder portion extending downward and connecting to a tubular sidewall extending downward and joining a bottom portion forming a base wherein the sidewall defines a container interior and comprises two substantially smooth opposing squeezable panels, each of which have at least one arcuate indentation adapted to allow flexure of the respective panel without permanent distortion or creasing when a force is applied to the panel toward the container interior and having a vacuum panel disposed between the squeezable panels, wherein after the force applied to the container is released, the container returns to approximately initial shape.

In an exemplary embodiment, the squeezable panel may comprise an undulating surface providing a smooth transition into the arcuate indentation. The arcuate indentation may be concave shaped. In an alternative embodiment, the squeezable panel may comprise three arcuate indentations. In other embodiments, after force is applied toward the container interior, the squeezable panel may decrease in convexity, become vertically straight or concave, or increase in concavity and the arcuate indentation may increase in concavity. In one aspect, the squeezable panel may be vertically concave and the arcuate indentation may be more concave.

The squeezable panel may be a grip panel. In one exemplary embodiment, the force applied may be that provided by squeezing the opposing squeezable panels with at least one hand to facilitate movement of the panels unto each other. The squeezing may result in product being dispensed from the container.

In another embodiment, the sidewall may comprise two squeezable panels and two vacuum panels and include vertical transitional walls disposed between adjoining panels, and wherein the body is adapted to increase volume contraction and reduce pressure, and the panels are adapted to contract inwardly in response to internal negative pressure due to packaging or subsequent handling and storage. In one aspect of the invention, the internal negative pressure may be created during hot-fill processing and subsequent cooling of a hot liquid in the container.

In one exemplary embodiment of the invention, the panels may comprise a pair of opposing primary panels and opposing secondary panels. The squeezable panels may be the secondary panels with at least one arcuate indentation. The primary panels may comprise smaller surface area than the secondary panels. In one exemplary aspect, the shoulder and base of the container are substantially round.

In another exemplary embodiment, the present invention relates to a method of making a blow-molded PET container having an externally-threaded mouth finish. A preform can be disposed in a mold cavity having a mold surface with a container body region, wherein the container body region is configured to form the container and the container comprises a body portion having a tubular sidewall extending downward and joining a bottom portion forming a base. The sidewall may define a container interior and comprise two substantially smooth opposing squeezable panels, each of the panels having at least one arcuate indentation and a vacuum panel disposed between the squeezable panels. The neck portion may have an externally-treaded blown finish and include a shoulder portion extending downward and connecting the tubular sidewall to the neck portion. The preform may be distended against the mold surface to form an intermediate container article having a moil portion superadjacent a threaded portion.

BRIEF DESCRIPTION OF THE DRAWINGS

The foregoing and other features and advantages of the invention will be apparent from the following, more particular description of a preferred embodiment of the invention, as illustrated in the accompanying drawings wherein like reference numbers generally indicate identical, functionally similar, and/or structurally similar elements.

DETAILED DESCRIPTION

Figure 1:
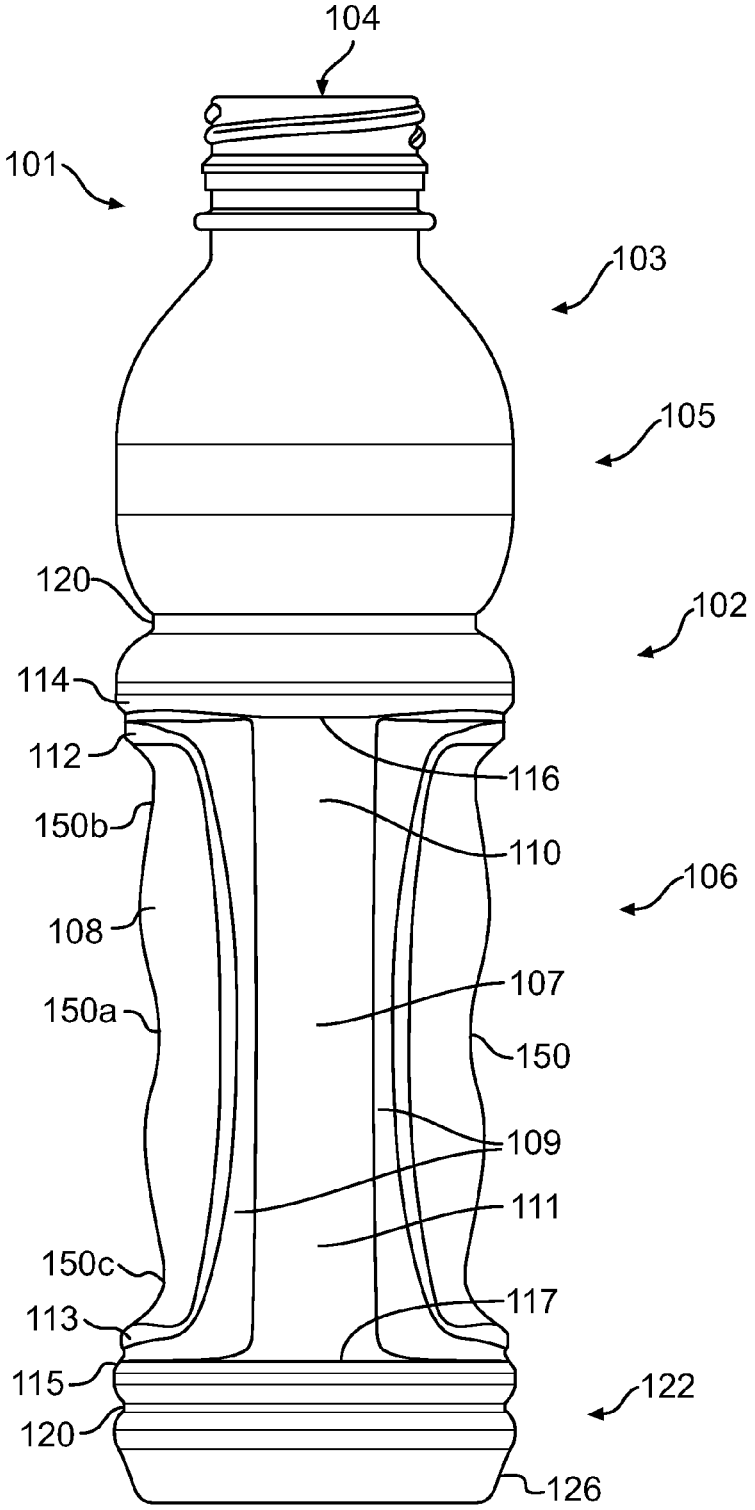
FIG. 1 shows a front elevation view of a container according to an exemplary embodiment of the present invention.

The present invention, e.g., FIG. 1, relates to a container 101 having a tubular sidewall 106 defining the container interior. The sidewall comprises two substantially smooth opposing squeezable panels 108, each of the panels 108 having at least one arcuate indentation 150, and each of the arcuate indentations 150 adapted to allow flexure of the respective panel 108 without permanent distortion or creasing when a force is applied to the panel 108 toward the container interior. The container 101 may further comprise a vacuum panel 107 disposed between the squeezable panels 108 and wherein, after the force applied to the container 101 is released, the container 101 returns to approximately its initial shape.

The novel design of container 101 provides an integrated portion having a squeezable grip and that accounts for changes in internal vacuum pressure, so as to allow and end user to easily grip and squeeze to dispense product without undue denting or distortion of the grip panels 108.

As shown in FIG. 1, the container 101 may comprise a plastic body 102 having a neck portion 103 defining an opening 104, connected to a shoulder portion 105 extending downward and connecting to a tubular sidewall 106 defining said container interior and extending downward and joining a bottom portion 122 forming a base 126. The neck portion 103 can be adapted to receive a cap or closure (not shown). The sidewall 106 includes controlled deflection flex panels 107 and 108 and includes a vertical transitional wall 109 disposed between and joining the panels 107 and 108. The opposing panels 108 can be substantially smooth and having at least one arcuate indentation 150.

The arcuate indentations 150 are adapted to allow flexure of the respective panel 108 without permanent distortion or creasing when a force is applied to the secondary panel 108 toward the container interior. The panels 107 are disposed between the squeezable panels 108 so that after the force applied to the container 101 is released, the container 101 returns to approximately its initial shape. The body 102 of the container 101 is also adapted to increase volume contraction and reduce pressure during hot-fill processing, and the panels 107 and 108 are adapted to contract inward from vacuum forces created from the cooling of a hot liquid during hot-fill application.

The container 101 can be used to package a wide variety of liquid, viscous or solid products including, for example, juices, other beverages, yogurt, sauces, pudding, lotions, soaps in liquid or gel form, and bead shaped objects such as candy.

The present container can be made by conventional blow molding processes including, for example, extrusion blow molding, stretch blow molding and injection blow molding. In extrusion blow molding, a molten tube of thermoplastic material, or plastic parison, is extruded between a pair of open blow mold halves. The blow mold halves close about the parison and cooperate to provide a cavity into which the parison is blown to form the container. As formed, the container can include extra material, or flash, at the region where the molds come together, or extra material, or a moil, intentionally present above the container finish. After the mold halves open, the container drops out and is then sent to a trimmer or cutter where any flash of moil is removed. The finished container may have a visible ridge formed where the two mold halves used to form the container came together. This ridge is often referred to as the parting line.

In stretch blow molding, a preformed parison, or preform, is prepared from a thermoplastic material, typically by an injection molding process. The preform typically includes a threaded end, which becomes the threads of the container. The preform is positioned between two open blow mold halves. The blow mold halves close about the preform and cooperate to provide a cavity into which the preform is blown to form the container. After molding, the mold halves open to release the container. In injection blow molding, a thermoplastic material, is extruded through a rod into an inject mold to form a parison. The parison is positioned between two open blow mold halves. The blow mold halves close about the parison and cooperate to provide a cavity into which the parison is blown to form the container. After molding, the mold halves open to release the container.

The size of the container may accommodate an internal volume of from about 8 to 64 ounces, from about 16 to 24 ounces or 16, 17 ounces or 20 ounces. In one aspect, the size of the volume is about 17 ounces. The weight of the container may be based on gram weight as a function of surface area, e.g., 4.5 square inches per gram to 2.1 square inches per gram.

The sidewall, as formed, is substantially tubular and can have a variety of cross sectional shapes. Cross sectional shapes include, for example, a circular transverse cross section; a substantially square transverse cross section; other substantially polygonal transverse cross sectional shapes such as triangular, pentagonal, etc.; or combinations of curved and arced shapes with linear shapes. As will be understood, when the container has a substantially polygonal transverse cross sectional shape, the corners of the polygon are typically rounded or chamfered.

In an exemplary embodiment, the shape of container, e.g., the sidewall, the shoulder and/or the base of the container may be substantially round or substantially square shaped.

The container 101 has a one-piece construction and can be prepared from a monolayer plastic material, such as a polyamide, for example, nylon; a polyolefin such as polyethylene, for example, low density polyethylene (LDPE) or high density polyethylene (HDPE), or polypropylene; a polyester, for example polyethylene terephthalate (PET), polyethylene naphtalate (PEN); or others, which can also include additives to vary the physical or chemical properties of the material. For example, some plastic resins can be modified to improve the oxygen permeability. Alternatively, the container can be prepared from a multilayer plastic material. The layers can be any plastic material, including virgin, recycled and reground material, and can include plastics or other materials with additives to improve physical properties of the container. In addition to the above-mentioned materials, other materials often used in multilayer plastic containers include, for example, ethylvinyl alcohol (EVOH) and tie layers or binders to hold together materials that are subject to delamination when used in adjacent layers. A coating may be applied over the monolayer or multilayer material, for example to introduce oxygen barrier properties. In an exemplary embodiment, the present container may be made of a generally biaxially oriented polyester material, e.g., polyethylene terephthalate (PET), polypropylene or any other organic blow material which may be suitable to achieve the desired results.

In another embodiment, the shoulder portion, the bottom portion and/or the sidewall may be independently adapted for label application. The container may include a closure (not shown) engaging the neck portion and sealing the fluid within the container.

As illustrated in the exemplary embodiment of FIG. 1, the sidewall 106 can include four controlled deflection flex (vacuum) panels, 107 and 108, and a vertical transitional wall 109 disposed between and joining the panels 107 and 108. The panels 108 are designed as grip panels that easily move in relation to each other to provide greater flexibility (squeezable) and resilience (return to their original shape or bounce back). The exemplary container includes two opposing panels 108 that are substantially smooth and have at least one arcuate indentation 150 (definitive arcuate indentations or flex point) to provide points for easier flexing and bending when a force is applied in such a way as to compress the two panels 108 onto each other. That is, the panels 108 have an undulating surface that can provide a smooth transition into the arcuate indentation 150. Having at least one arcuate indentation allows a greater displacement (i.e. more than would naturally occur as a result of the hot-filling process) without buckling or creasing of the plastic. Panels 107 are configured as vacuum panels to relieve negative internal pressure within the container. The configuration of the panels 107 and the vertical transitional wall 109, assist in returning the panels 108 to the original shape.

The arcuate indentations 150 are adapted to allow flexure of the respective panel 108 without permanent distortion or creasing when a force is applied to the panel 108 toward the container interior. The panels 107 are disposed between the squeezable panels 108 so that after the force applied to the container 101 is released, the container 101 returns to approximately its initial shape.

The arcuate indentation 150 may be positioned centrally or offset vertically towards the upper or lower portion in relation to the panel 108. In another exemplary embodiment, the panel 108 may comprise of at least two or three arcuate indentations 150. For example, as set forth in FIG. 1, the panel 108 comprises three arcuate indentations, 150*a*, 150*b* and 150*c*.

The panels 108 may be designed to have an overall shape in the vertical direction that is convex, substantially straight/flat or concave shaped and/or combinations thereof, with the arcuate indentations 150 superimposed upon this overall shape. For example, for an overall concave surface, the arcuate indentation 150 may be more concave than the overall shape. When pressure or force is applied to the panel 108 toward the container interior, the panel 108 may decrease in convexity, become vertically straight/flat or concave, or increase in concavity and the arcuate indentation 150 becomes more concave.

In another exemplary embodiment, the squeezable container may be designed to deliver or dispenses a product when squeezed. In this embodiment, the container, once opened, may be easily held or gripped, e.g., with one hand, and with little resistance, the container may be squeezed along the panels 108 to dispense product there from. Once squeezing pressure is reduced, the container retains its original shape without undue distortion.

In an exemplary embodiment, the container is able to withstand internal volumetric and barometric changes due to packaging or handling, e.g., during the rigors of hot fill processing. In a hot fill process, a product is added to the container at an elevated temperature, about 82° C., which can be near the glass transition temperature of the plastic material, and the container is capped. As the container and its contents cool, the contents tend to contract and this volumetric change creates a partial vacuum within the container. Other factors can cause contraction of the container content, creating an internal vacuum that can lead to distortion of the container. For example, internal negative pressure may be created when a packaged product is placed in a cooler environment, e.g., placing a bottle in a refrigerator or a freezer, or from moisture loss within the container during storage.

In the absence of some means for accommodating these internal volumetric and barometric changes, containers tend to deform and/or collapse. For example, a round container can undergo ovalization, or tend to distort and become out of round. Containers of other shapes can become similarly distorted. In addition to these changes that adversely affect the appearance of the container, distortion or deformation can cause the container to lean or become unstable. This is particularly true where deformation of the base region occurs. As supporting structures are removed from the side panels of a container, base distortion can become problematic in the absence of mechanism for accommodating the vacuum. Moreover, configuration of the panels provides additional advantages, e.g., improved top-load performance allowing the container to be lighter in weight.

This exemplary design of container increases volume contraction and vacuum uptake, thereby reducing negative internal pressure and unnecessary distortion of the container to provide improved aesthetics, performance and end user handling. In an exemplary embodiment, the container may have four controlled deflection flex (vacuum) panels comprising a pair of primary panels and a pair of secondary panels, which work in tandem in primary and secondary capacity, thereby reducing the negative internal pressure effects during cooling of a product. Panels 107 may comprise the primary panels and panels 108 may comprise the secondary panels. The primary panels 107 may comprise an upper and lower portion, 110 and 111, respectively, and the secondary panels 108 may comprise an upper and lower panel walls, 112 and 113, respectively.

Generally, the primary panels may comprise smaller surface area and/or have a geometric configuration adapted for greater vacuum uptake than the secondary panels. In an exemplary embodiment, the size of the secondary panel to primary panel may be slightly larger than the primary panel, e.g., at least about 1:1. In another aspect, the size of the secondary panel to primary panel may be in a ratio of about 3:1 or 7:5 or the secondary panel may be at least 70% larger than the primary panel, or 2:1 or 50% larger.

Prior to relief of negative internal pressure, e.g., during hot-fill processing, the primary panels and secondary panels may be designed to be convex, substantially straight/flat or concave shaped, and/or combinations thereof, so that after cooling of a closed container or after filling the container with hot product, sealing and cooling, the primary panels and/or secondary panels would decrease in convexity, become vertically straight/flat or increase in concavity. The convexity or concavity of the primary and/or the secondary panels may be in the vertical or horizontal directions, e.g., in the up and down direction or around the circumference, respectively, or both. In alternative embodiments, the secondary panels may be slightly convex while the primary panels are substantially straight/flat, concave or less convex. Alternatively, the secondary panels may be substantially straight/flat and the primary panel concave.

The primary and secondary panels cooperate to relieve internal negative pressure due to packaging or subsequent handling and storage. Of the pressure relieved, the primary panels are responsible for greater than 50% of the vacuum relief or uptake. The secondary panel may be responsible for at least a portion, e.g., 15% or more, of the vacuum relief or uptake. For example, the primary panels may absorb greater than 50%, 56% or 85% of a vacuum developed within developed within the container, e.g., upon cooling after hot-filling.

Generally, the primary panels are substantially devoid of structural elements, such as ribs, and are thus more flexible, have less deflection resistance, and therefore have more deflection than secondary panels, although some minimal ribbing may be present to add structural support to the container overall. The panels may progressively exhibit an increase in deflection resistance as the panels are deflected inward.

The primary or secondary panels may independently vary in width progressing from top to bottom thereof, e.g., the panels may remain similar in width progressing from top to bottom thereof (linear), may have an hour-glass shape, may have an oval shape having a wider middle portion than the top and/or bottom, or the top potion of the columns may be wider than the bottom portion of the panel (expanding) or vice-a-versa.

In another embodiment, as exemplified in FIG. 1, the primary panels 107 are vertically concave and have a generally consistent width progressing from top to bottom thereof. The secondary panels 108 are vertically concave and horizontally convex and have a generally consistent width progressing from top to bottom thereof.

The container 101 may also include an upper bumper wall 114 between the shoulder 105 and the sidewall 106 and a lower bumper wall 115 between the sidewall 106 and the bottom portion 122. The upper and/or lower bumper walls may define a maximum diameter of the container, or alternatively may define a second diameter, which may be substantially equal to the maximum diameter.

Figure 2:
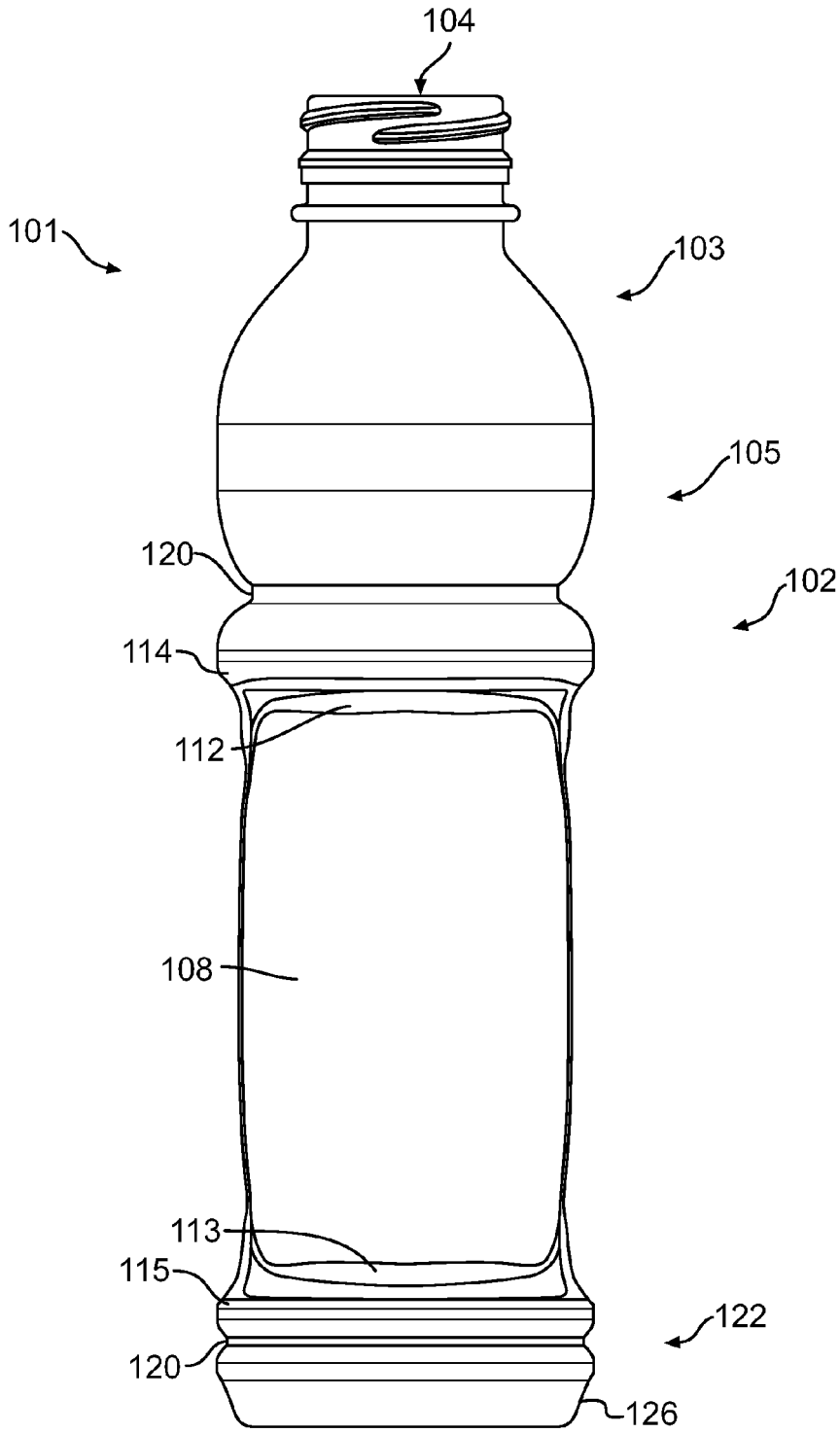
FIG. 2 shows a side elevation view of the container shown in FIG. 1.
Figure 3:
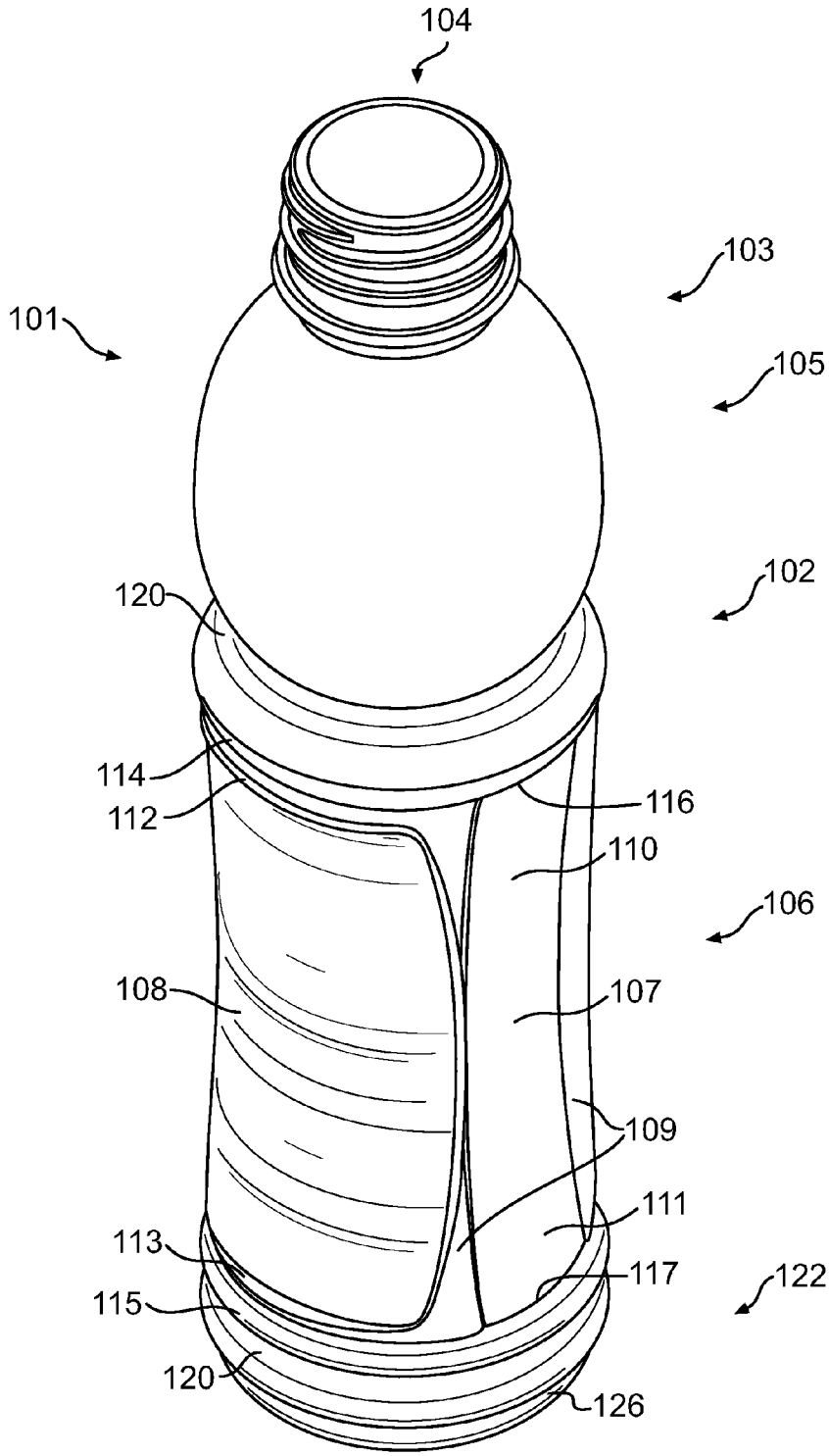
FIG. 3 shows a prospective view of the container shown in FIGS. 1 and 2.
Figure 4:
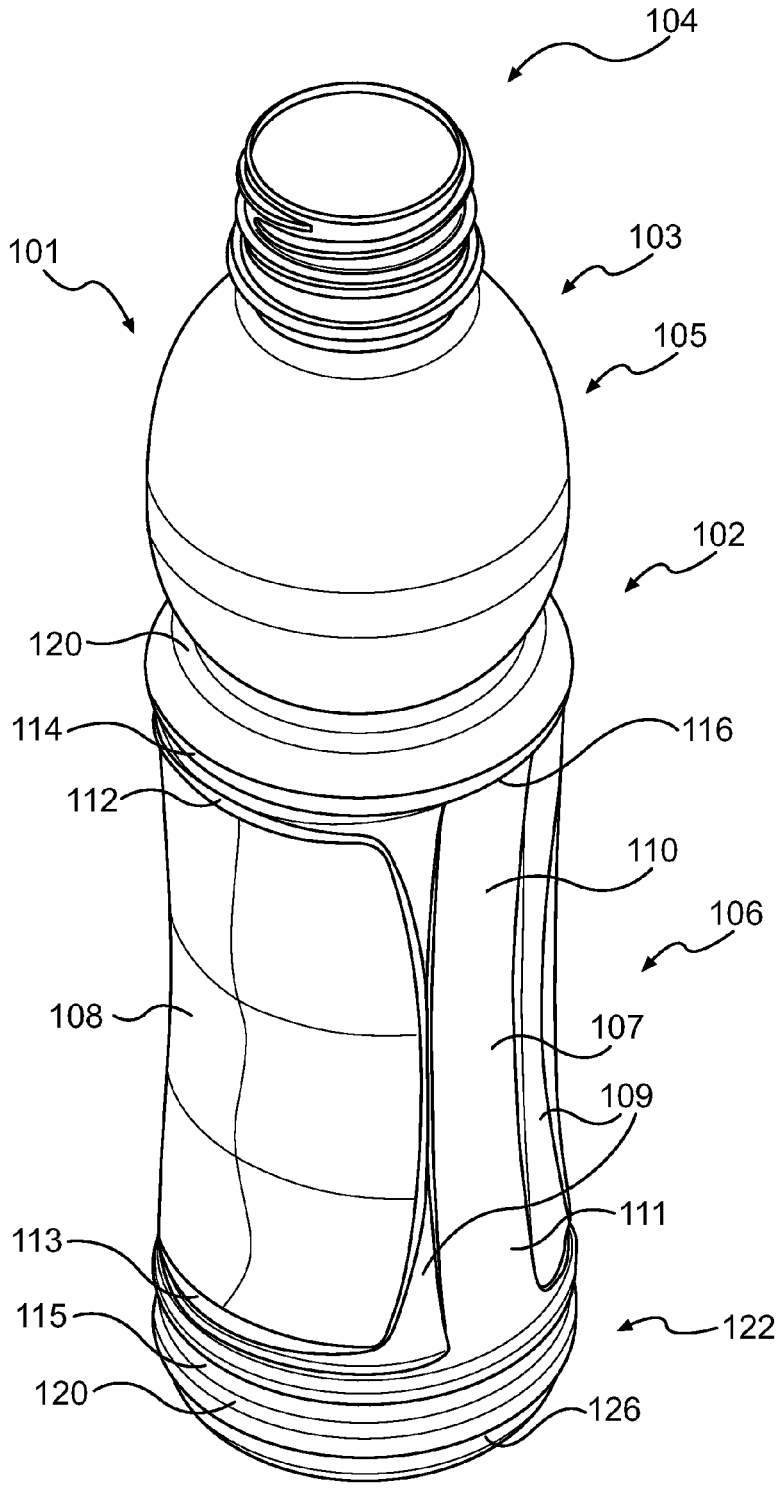
FIGS. 4 and 5 are additional representations of prospective views of the container, similar to FIG. 3, showing contour lines and shading, respectively.
Figure 5:
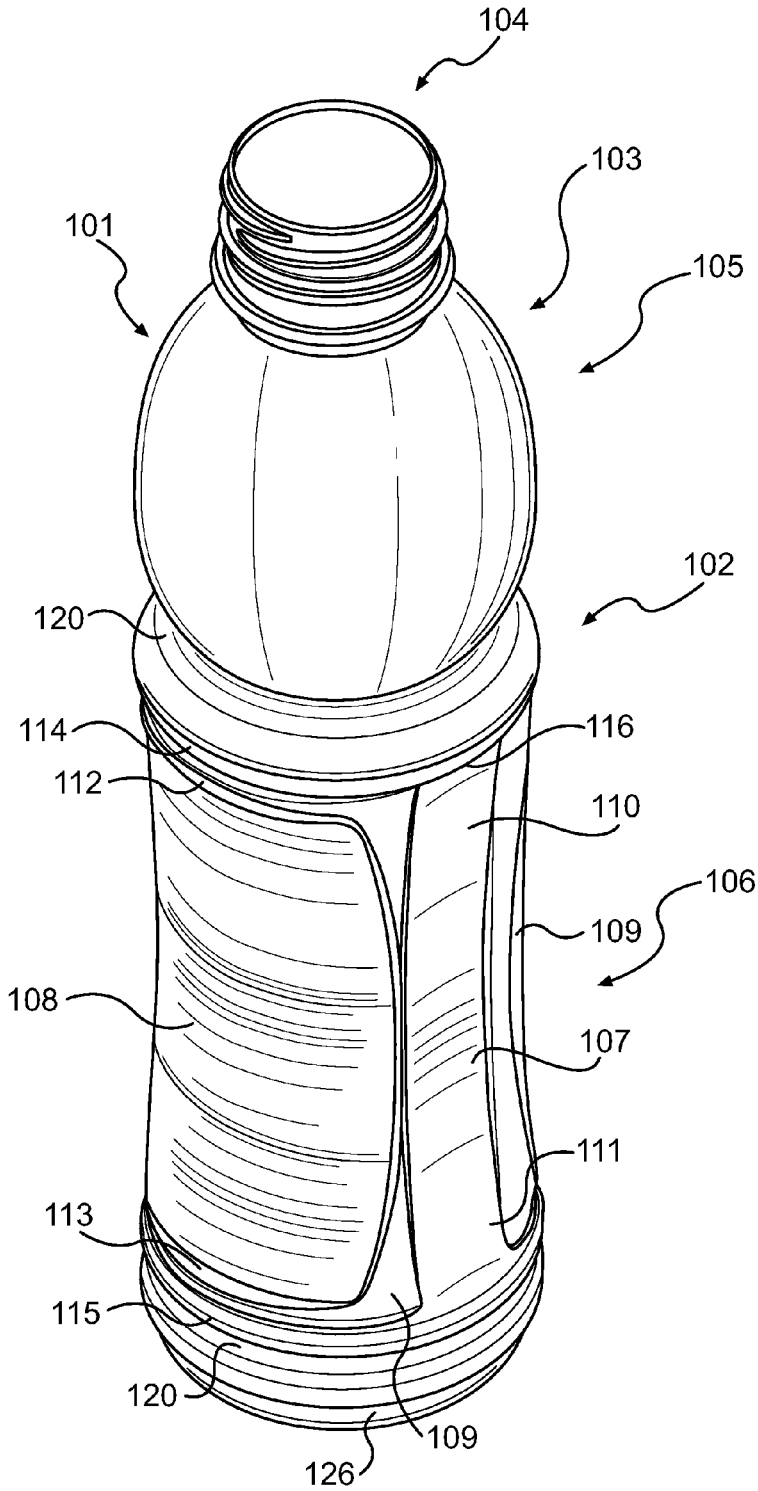
Figure 6:
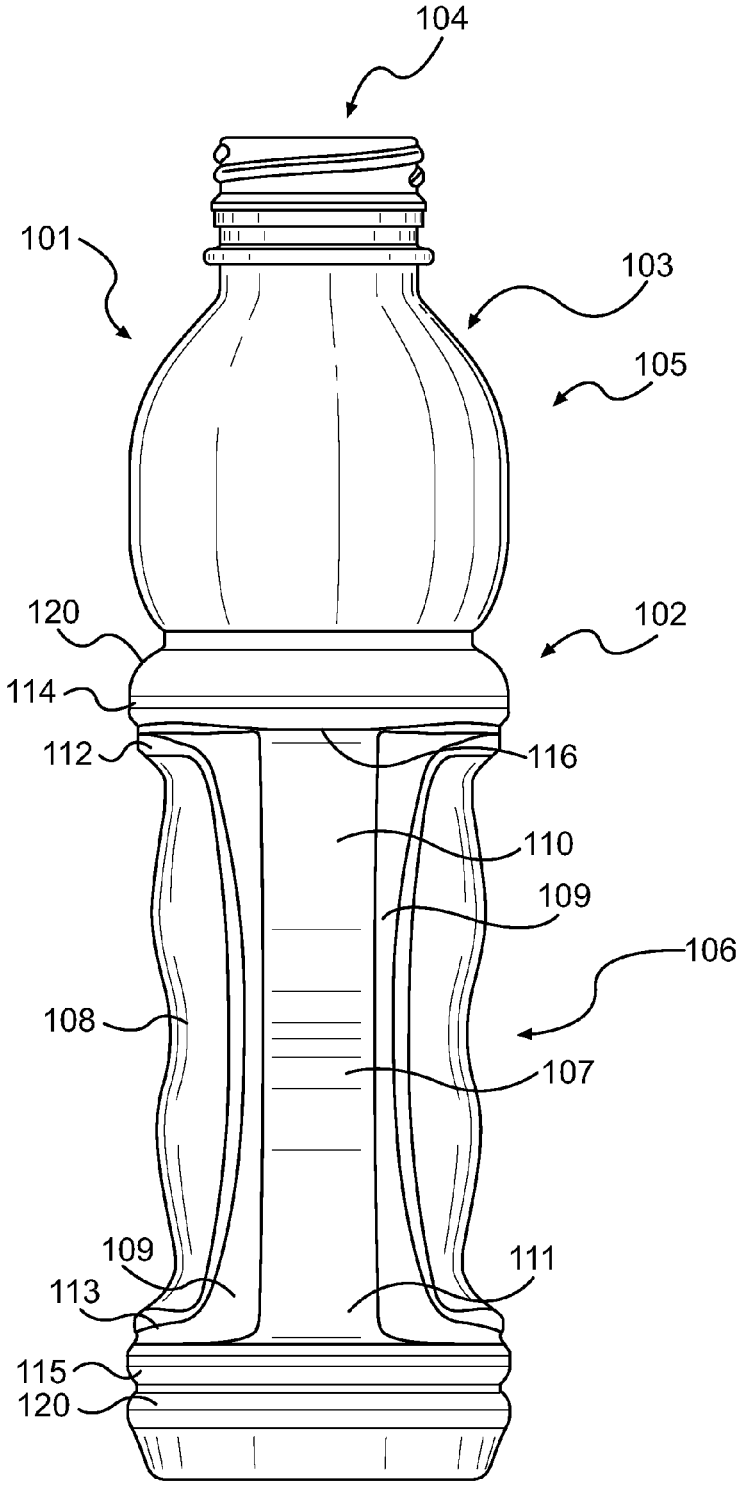
FIG. 6 is an additional representation of a front view of the container, similar to FIG. 1, showing shading.

In the embodiments exemplified in FIGS. 1 and 2, the upper bumper wall, e.g., 114, and lower bumper wall, e.g., 115, may extend continuously along the circumference of the container. As exemplified in FIGS. 1 and 2, the container 101 may also include horizontal transitional walls 116 and 117 defining the upper portion 110 and lower portion 111 of the primary panel 107 and connecting the primary panel to the bumper wall.

In an exemplary embodiment, the panels 108 with the arcuate indentation 150 provide grip regions and are secondary panels providing secondary means of vacuum uptake, while the primary panels 107 provide the primary means of vacuum uptake. The resultant exemplary design thereby reduces the internal pressure and increasing the amount of vacuum uptake and reduces label distortion, while still providing grippable regions to facilitate end user/consumer handling.

The panels 108 may include other features such as shallow grooves, horizontal ribbing or other inwardly or outwardly projecting structures that do not deter from the flexibility of the panels 108 as provided by the present invention. These structures can provide non-slip features or additional grippable support.

As can be seen in FIG. 1, the container 101 may include at least one recessed rib or groove 120 between the upper bumper wall 114 and the shoulder portion 105 and/or between the lower bumper wall 115 and the base 126. The recessed rib or groove 120 may be continuous along the circumference of the container 101 (FIGS. 1 and 2).

In an alternative embodiment, the panels, shoulder portion, the bottom portion and/or the sidewall may include an embossed motif or lettering (not shown).

The invention has been disclosed in conjunction with presently preferred embodiments thereof, and a number of modifications and variations have been discussed. Other modifications and variations will readily suggest themselves to persons of ordinary skill in the art. In particular, various combinations of configurations of the primary and secondary panels may be utilized. Various other container features may also be incorporated with some combinations. For example, the present invention may include combinations of differently configured primary and secondary panels other than those described or alternative configurations with different container features as described, e.g., in concurrently filed commonly owned U.S. patent application Ser. No. 11/529,486, filed Sep. 29, 2006, which is incorporated herein by reference in its entirety. The invention is intended to embrace all such modifications and variations as fall within the spirit and broad scope of the appended claims.

I claim:

1. A container comprising a plastic body having a neck portion defining an opening, connected to a shoulder portion extending downward and connecting to a tubular sidewall extending downward and joining a bottom portion forming a base, said sidewall defining a container interior and comprising two substantially smooth opposing squeezable panels, each of said panels having squeezable at least one arcuate indentation adapted to allow flexure of the respective panel without permanent distortion or creasing when a force is applied to the panel toward the container interior; and two opposing vacuum panels wherein each of said vacuum panels is disposed between said squeezable panels and is vertically concave and has a generally consistent width throughout, and vertical transitional walls disposed between said vacuum panels and said squeezable panels; wherein after the force applied to the container is released, the container returns to approximately initial shape.

2. The container of claim 1, wherein each of said squeezable panels comprises an undulating surface providing a smooth transition into the arcuate indentation.

3. The container of claim 1, wherein the arcuate indentation is concave shaped.

4. The container of claim 1, wherein each of said squeezable panels comprises three arcuate indentations.

5. The container of claim 1, wherein after force is applied toward the container interior, each of said squeezable panels decreases in convexity, becomes vertically straight or concave, or increases in concavity and the arcuate indentation increases in concavity.

6. The container of claim 1, wherein each of said squeezable panels is vertically concave and the arcuate indentation is more concave.

7. The container of claim 1, wherein each of said squeezable panels is a grip panel.

8. The container of claim 1, wherein the force applied is that provided by squeezing the opposing squeezable panels with at least one hand to facilitate movement of the panels unto each other.

9. The container of claim 1, wherein after squeezing the container, product is dispensed from the container.

10. The container of claim 1, wherein said vacuum panels comprise smaller surface area than said squeezable panels.

11. The container of claim 1, wherein the shoulder and base are substantially round.

12. The container of claim 1, wherein said body is adapted to increase volume contraction and reduce pressure, and said panels are adapted to contract inwardly in response to internal negative pressure due to packaging or subsequent handling and storage.

13. The container of claim 12, wherein the internal negative pressure is created during hot-fill processing and subsequent cooling of a hot liquid in said container.

* * * * *